US005605442A

United States Patent [19]

Wilson et al.

[11] Patent Number: 5,605,442

[45] Date of Patent: Feb. 25, 1997

[54] CENTRIFUGAL PUMP FOR PUMPING FIBER SUSPENSIONS

[75] Inventors: George Wilson, Skaneateles; Daniel R. Roll, Seneca Falls, both of N.Y.

[73] Assignee: Goulds Pumps Incorporated, Seneca Falls, N.Y.

[21] Appl. No.: 437,187

[22] Filed: May 8, 1995

Related U.S. Application Data

[63] Continuation of Ser. No. 78,575, Jun. 17, 1993, Pat. No. 5,413,460.

[51] Int. Cl.[6] ..... F04D 1/00; F04D 29/60

[52] U.S. Cl. ..... 415/206; 415/213.1; 416/188; 416/223 B

[58] Field of Search ..... 415/169.1, 206, 415/213.1, 121.1; 416/185, 188, 223 B

[56] References Cited

U.S. PATENT DOCUMENTS

| | | | |
|---|---|---|---|
| 3,560,106 | 2/1971 | Sahlstrom | 415/206 |
| 4,770,604 | 9/1988 | Luthi et al. | 415/169.1 |
| 4,981,413 | 1/1991 | Elonen et al. | 415/169.1 |
| 5,039,320 | 8/1991 | Hoglund et al. | 415/169.1 |
| 5,114,310 | 5/1992 | Haavik et al. | 415/169.1 |

FOREIGN PATENT DOCUMENTS

| | | | |
|---|---|---|---|
| 2059616 | 6/1971 | Germany | 415/121.1 |
| 92/11458 | 7/1992 | WIPO | 415/169.1 |

*Primary Examiner*—James Larson
*Attorney, Agent, or Firm*—Leydig, Voit & Mayer, Ltd.

[57] ABSTRACT

A centrifugal pump of the type adapted to pump high consistency fiber suspensions includes impeller vanes having portions which are immediately adjacent the fiber suspension in the interior of a vessel from which the suspension is to be pumped. The pump additionally includes a sideplate which is mounted directly to the vessel containing the fiber suspension so as to permit the impeller of the pump-to be brought in close proximity to the fiber suspension in the vessel. The sideplate additionally includes elongated portions that extend along the outer contour of the vanes of the impeller to determine the directions from which fiber suspension enters the impeller of the pump.

18 Claims, 5 Drawing Sheets

CENTRIFUGAL PUMP FOR PUMPING FIBER SUSPENSIONS

This is a continuation of application Ser. No. 08/078,575, filed Jun. 17, 1993, now U.S. Pat. No. 5,413,460.

FIELD OF THE INVENTION

The present invention relates to centrifugal pumps for pumping high consistency fiber suspensions and, more particularly, to such centrifugal pumps which are constructed so that the pump impeller vanes are located in close proximity to the interior of a vessel from which the suspension is pumped.

BACKGROUND OF THE INVENTION

Centrifugal pumps may be used in a number of applications involving the pumping of suspensions having a fiber content. In the paper making industry, for example, centrifugal pumps have been used for many years to pump the fibrous pulp slurries that are used in the paper making process from one processing station to another. In different configurations, centrifugal pumps have been utilized to pump slurries or suspensions having varying consistencies of wood pulp content, ranging from less than 1% to nearly 20% by weight.

At certain points in the paper making process, or at all points in certain processes, it can be advantageous to maintain the suspension at a high consistency. In such situations, it may be economical and beneficial to employ a centrifugal pump, as opposed to a positive displacement pump or other type of pump, to pump the fiber suspension. Centrifugal pumps of conventional design, i.e., designed for pumping clear liquid, can successfully pump from a vessel fiber suspensions having consistencies as high as 3% to 10% with at most only minor modifications to certain dimensions and clearances depending upon the suction pressure, the type of fiber, the air content and other factors. Aside from those factors, however, such a conventional pump is not able to adequately move fiber suspensions above a certain consistency from the vessel and through the pump's inlet pipe to the pump's impeller. This is due to the fiber suspension's tendency to create flocs or clumps of fibers. The fibers and fiber flocs inherently entangle to form networks or structures that do not flow as a Newtonian liquid. In particular, the flocs have difficulty passing from the vessel interior into the pump's inlet pipe or nozzle which leads to the eye of the impeller. In effect, a bottle-neck occurs at the transition from the vessel to the pump inlet pipe at which point the fiber network tends to clog and grow in size until movement of fiber suspension into the pump inlet is reduced or stopped. This reduces the pump output or can cause the pump to lose its prime and cease pumping altogether.

Most prior efforts to overcome the above-mentioned problem of centrifugally pumping high consistency fiber suspensions have focused on providing a rotating device upstream of the pump impeller and near the transition from the vessel outlet to the pump's inlet pipe or nozzle. Such rotating devices, which have been referred to as propellers, feeders, fluidizers, breaker impellers and the like, serve to create a shear rate in the suspension sufficient to cause additional relative movement between flocs near the transition from the vessel outlet to the pump's inlet pipe. This additional relative movement or agitation of flocs caused by the rotating device prevents clogging at the transition with fiber suspensions having consistencies considerably higher than would be possible without the rotating device. For example, the provision of such a rotating device can enable a centrifugal pump to accommodate suspensions with consistencies as high as nearly 20%.

Examples of prior centrifugal pumps having rotating devices as described above are shown in U.S. Pat. Nos. 4,780,053 and 4,854,819. In some cases, the rotating device has been configured with a twist or pitch to provide, in addition to the agitation described above, a force on the suspension through the inlet pipe and toward the eye of the impeller. Certain prior configurations included a plurality of such rotating devices, while others utilized a single rotating device. In some prior configurations, the rotating device was driven by an extension of the shaft driving the pump impeller. In others, a separate drive shaft was provided.

In any case, the prior configurations described above were the result of efforts to modify the conventional design to overcome the problems of clogging at high consistencies. As a result, although these pumps are capable of pumping the high consistency fiber suspensions, they have certain drawbacks and deficiencies.

One shortcoming of the prior pumps is that they are relatively complicated and have rotors which extend into the pump inlet pipe and, in some cases, into the vessel itself. As a result, the prior pumps included a significant amount of machinery simply for the purpose of agitating the suspension and, in some cases, urging it into the pump inlet pipe or toward the pump's impeller vanes. This has resulted in increased costs of manufacture and added complexity of manufacture, installation and servicing.

Another shortcoming of prior pumps is that the rotating device, by creating a shear rate in the suspension, requires a significant amount of power that does not contribute to the flow rate or pressure generated by the pump. As a result, a larger, more costly, motor may be required to drive the pump, or an additional motor may be required to drive the rotating device. Thus, the energy efficiency of the pump is adversely affected.

Yet another shortcoming of the prior pumps is that, by simply including a rotating device upstream of the impeller in a pump having an inlet pipe, the friction losses caused by the inlet pipe itself are not avoided. Even the minimal length of the inlet pipe of a standard centrifugal pump creates enough losses to severely impair or halt the performance of such pumps at high consistencies.

SUMMARY OF THE INVENTION

Accordingly, a general object of the present invention is to provide a centrifugal pump for pumping high consistency fiber suspensions which enables the impeller of the pump to be disposed in close proximity to the interior of a vessel containing the fiber suspension.

Another general object of the invention is to minimize the flow resistance and friction losses as the fiber suspension flows to the impeller vanes of the pump.

Yet another object of the invention is to simplify the construction of the pump so that flow toward the impeller of the pump is not obstructed or impaired by such things as a pump inlet pipe or rotating devices.

Yet another general object of the invention is to increase the efficiency of the centrifugal pump by simplifying the structure of the pump to eliminate additional and unneeded structures.

A further object is to improve the energy efficiency of a centrifugal pump for high consistency fiber suspensions.

An additional object is to provide a centrifugal pump capable of accommodating higher consistency fiber suspensions and requiring a lower suction pressure.

The foregoing and other objects are, in the present invention, embodied in an improved apparatus for pumping high consistency fiber suspensions. In one embodiment, the impeller vanes are disposed adjacent and in close proximity to the fiber suspension contained within a vessel from which the suspension is to be pumped. Rather than having a pump inlet pipe, nozzle or similar structure that attaches to the vessel outlet, a pump incorporating the present invention can include a sideplate constructed to be attached to the vessel while providing a wear surface for the impeller vanes of the pump. Moreover, the construction of a pump incorporating the present invention, enables the impeller vanes of the pump to pump a high consistency fiber suspension without requiring any type of rotating device upstream of the impeller.

In accordance with one aspect of the present invention, high consistency fiber suspensions are pumped by utilizing a centrifugal pump having a sideplate mounted directly to the vessel, a pump housing including a bearing frame and a rotatable shaft, and an impeller which is mounted on the shaft of the housing and rotates in close proximity with said sideplate and the fiber suspension which is present in the vessel. The contour of the inner surface of the sideplate and the outer surface of the vanes of the pump impeller are substantially identical so that the sideplate acts as a wear plate for the impeller as well as rigidly connecting the pump to the vessel. Both the impeller vanes and the sideplate include elongated portions which extend into the vessel and the fiber suspension contained therein.

The pump may also include a volute collector and discharge nozzle which are mounted in similar fashion to the side plate and vessel. In the preferred embodiment, the pump housing is mounted to the structure of the volute collector and sideplate which are, in turn, mounted to the vessel. In order to examine the impeller vanes and access the vessel outlet, the housing of the pump and the impeller can be removed without having to access the inside of the vessel. Thus, the present invention provides an apparatus which can pump high consistency fiber suspensions while maintaining the impeller vanes in close proximity to the vessel interior.

As noted, an advantage of the present invention includes the ability to pump high consistency fiber suspensions without having to employ the structure of a pump inlet pipe or nozzle and without the need for a rotating device upstream of the impeller. Unlike other techniques for pumping high consistency fiber suspensions that include complicated structures for urging the fiber suspension towards the impeller vanes of the pump, the invention places the impeller vanes in close proximity to the fiber suspension thereby entirely avoiding the problem which leads to the requirement for such rotating devices. As a result, the invention increases the efficiency of the pump while minimizing its cost and complexity.

In accordance with one aspect of the present invention, the sideplate which is mounted on the vessel is constructed to extend with the leading edges of the impeller vanes into the vessel. In such an arrangement, the sideplate acts to direct the flow of fiber suspension from the vessel into the impeller vanes. By preventing the flow of fiber suspension from the side area of the impeller, the sideplate acts to direct the flow of fiber suspension in an axial direction from immediately in front of the impeller vanes. When pumping high consistency fiber suspensions, the impeller vanes are sometimes subjected to high forces due to the solid characteristics of the fiber suspension. As a result of the sideplate being substantially coextensive with the leading edges or tips of the impeller vanes, the vanes are provided with additional support.

In accordance with another aspect of the present invention, the sideplate of the pump assembly only partially extends along the outer contour of the impeller vanes. As a result, a portion of the impeller vanes extends into the vessel area and the fiber suspension contained therein. Being that there is no sideplate extension to direct the flow of fiber suspension into the impeller vanes, the fiber suspension is permitted to flow into the impeller from all directions. While the flow of the pump may in certain circumstances be increased by the fiber suspension being permitted to flow into the impeller of the pump from various directions, the impeller vanes do not have the additional support that the sideplate can provide when it is coextensive with the impeller vanes.

In accordance with another aspect of the invention, the sideplate and the pump as a whole are set back from the vessel by a space ring between the vessel's mounting flange and the sideplate of the pump. As a result of being set back, the sideplate and impeller do not extend into the vessel; however, the impellers are still brought into close proximity within the fiber suspension. This aspect of the invention is particularly useful where it is desirable not to have the impeller or sideplate of the pump extend into the vessel.

Other objects and advantages will become apparent from the following detailed description when taken in conjunction with attached drawings. Moreover, while the invention will be described in connection with certain preferred embodiments, it is not intended that the invention be limited to those specific embodiments but rather that it be accorded a broad scope commensurate with the appended claims, consistent with the prior art.

DETAILED DESCRIPTION OF THE PREFERRED EMBODIMENTS

Figure 1:
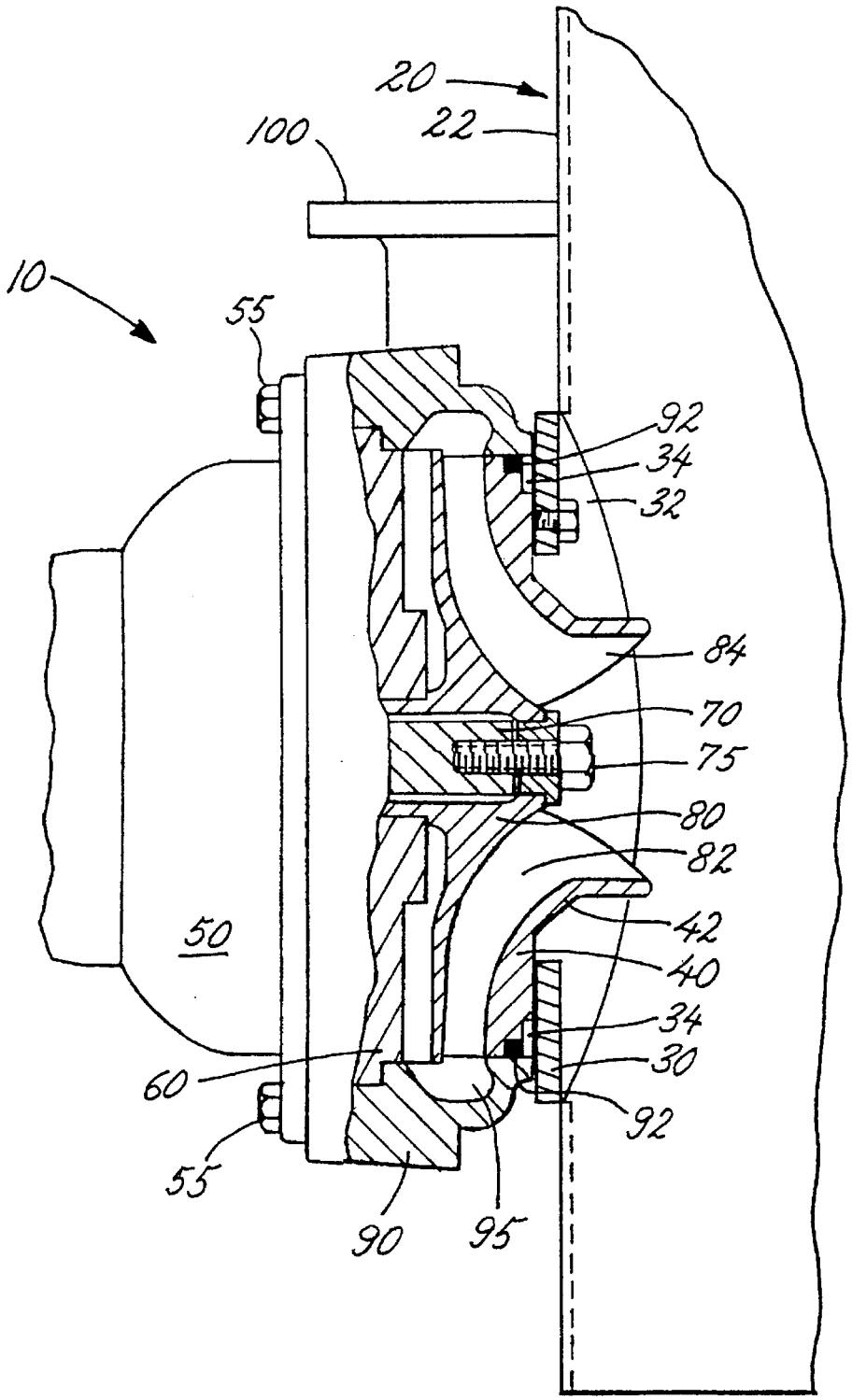
FIG 1 is a partial side view of the preferred embodiment of the invention, shown in cross-section.

Referring to FIG. 1, there is shown a preferred embodiment of the present invention in the form of centrifugal pump 10 mounted on vessel 20. Housing 50 of pump 10 includes bearing frame 60. Shaft 70 is mounted to bearing frame 60 so that it rotates about its center axis. Bearing frame 60 is stationary with respect to pump housing 50, though it is not necessarily formed integrally therewith. Pump impeller 80 is securely mounted on shaft 70 so that it turns as shaft 70 rotates.

Pump housing 50 is connected to volute collector 90 by conventional means such as bolts 55. In the preferred embodiment, discharge nozzle 100 is formed as part of volute collector 90 though it could be formed separately and attached to volute collector 90 utilizing conventional means such as bolts. Volute collector 90 forms space 95 with the radially outer limit of impeller 80 where the suspension is forced during the operation of pump 10. Space 95 communicates with discharge nozzle 100 so that the suspension can flow away from pump 10. When installed in a complete system, discharge nozzle 100 is connected to a pipe that leads away from pump 10.

Side plate 40 is attached to flange 30 with bolts 32 which extend from the inside of vessel 20 through flange 30 and into sideplate 40. To secure bolts 32, sideplate 40 is provided with threaded receiving holes at the appropriate locations (not shown). Although FIG. 1 shows sideplate 40 secured to flange 30 via bolts 32, it is to be recognized that a number of other means may be utilized to secure the sideplate. For instance, sideplate 40 could be welded to flange 30 or sideplate 40 could be cast as an integral part of vessel 20. In the preferred embodiment, seal 34 is placed between sideplate 40 and flange 30. Seal 34 is provided to prevent any leakage through the joint between sideplate 40 and flange 30.

Volute collector 90 is connected to sideplate 40 by appropriate means or is directly mounted on vessel 20. In the preferred embodiment as shown in FIG. 1, volute collector 90 is welded (shown as weld 92) to sideplate 40 along its inner circumference. However, it is to be recognized that volute collector 90 may be secured in a number of ways including bolting it to flange 30 or to sideplate 40, or forming it integrally with vessel 20. In whatever way volute collector 90 is secured, it should form a seal with sideplate 40 which prevents the escape of fluid from pump 10.

In the preferred embodiment, pump housing 50 is removably mounted to volute collector 90 with bolts 55. Access is provided to the impeller 80 and the inside of the pump by removing bolts 55 and separating pump housing 50 and impeller 80 from collector 90 and sideplate 40. By permitting access to the impeller and the inner mechanisms of the pump without requiring access to the interior of vessel 20, repairs to pump 10 are greatly facilitated.

As shown in FIG. 1, impeller 80 of pump 10 is connected to shaft 70 by bolt 75. Bolt 75 extends through a central portion of impeller and into shaft 70 along the center axis. Impeller 80 includes a multitude of vanes 82 which extend forward along the axis of rotation of the impeller. When assembled, the forward most surfaces of impeller vanes 82 are disposed in close proximity to the inner surface of sideplate 40. The close proximity of impeller vanes 82 and sideplate 40 facilitates the pumping of the fiber suspensions. As shown in FIG. 1, impeller vanes 82 include elongated portions 84 which extend in an axial direction substantially beyond the inner circumferential terminating point of the vanes. In the preferred embodiment, elongated portions 84 of impeller vanes 82 extend beyond the plane formed by the inner surface of wall 22 of vessel 20.

The elongated portions 84 of impeller vanes 82 allow for the impeller vanes of the pump to be disposed immediately adjacent the fiber suspension to be pumped. As a result, there is very little friction loss and resistance to the flow of the fiber suspension into impeller 80. Since the resistance to flow of the fiber suspension is substantially lower than if pump 10 included an inlet pipe, the suction pressure required to maintain proper flow through pump 10 is substantially reduced.

To restrict the pathways of flow into impeller 80, sideplate 40 is provided with an elongated portion 42 that follows the contour of extended portions 84 of impeller vanes 82. As shown in FIG. 1, elongated portion 42 of sideplate 40 remains in close proximity to the outer surface of impeller vanes 82 through the entire length of vanes 82 and portions 84. Besides controlling the direction of flow of fiber suspension from vessel 20, extended portion 42 of sideplate 40 provides added support to impeller vanes 82 at their furthest extended points. The added support helps prevent any deformation of impeller vanes 82 that might occur as a result of solids being present in the fiber suspension.

Figure 2:
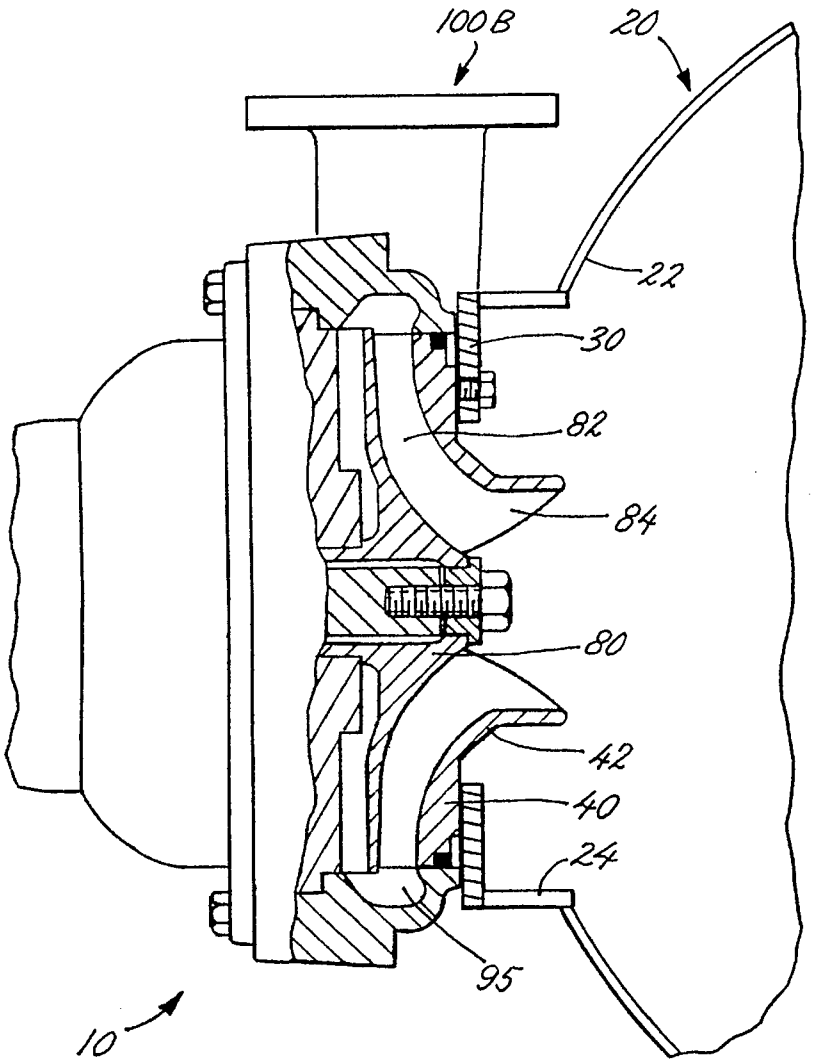
FIG. 2 is a partial top view of the same embodiment of the invention as shown in FIG. 1, except that the pump is shown mounted to the vessel so that the discharge nozzle is horizontal rather than vertical.

FIG. 2 shows the embodiment of the invention shown in FIG. 1 but as viewed from the top of vessel 20. It is initially noted that FIG. 2 is slightly different from FIG. 1 in that discharge nozzle 100B is shown extending horizontally away from vessel 20 rather than vertically as does discharge nozzle 100 in FIG. 1. The direction from which the discharge nozzle projects is a matter of installation choice. It is additionally noted that FIGS. 1 and 2 show discharge nozzles 100 and 100B extending tangentially from collection space 95; however, it is to be understood that the discharge nozzle could extend in other directions, as in a centerline discharge configuration.

FIG. 2 is substantively the same as FIG. 1, except that it provides another perspective of the placement of impeller 80 and sideplate 40 with respect to flange 30 and outer wall 22 of vessel 20. As shown in FIG. 2, in order to provide a flat surface with which sideplate 40 can interface, extension walls 24 are formed in vessel 20 which connect with flange 30.

As can be seen in FIG. 2, the extended portions 84 of impeller vanes 82 protrude past the cylindrical surface that would be defined by wall 22 if it were extended through the area where pump 10 is mounted on vessel 20. FIG. 2 also demonstrates the close proximity that is provided between impeller 80 of pump 10 and the fiber suspension within vessel 20. As shown, there are no obstructions between impeller vanes 82 and the fiber suspension which is present in vessel 20. Consequently, the flow resistance created by the structure of pump 10 and vessel 20 is minimized to such a degree that there is no need for any disruption or agitation of the fiber suspension held in vessel 20. The static pressure created in the vessel by the fiber suspension itself creates enough pressure for pump 10 to operate at consistencies greater than 16% without any clogging of flocs exiting the vessel.

Figure 3:
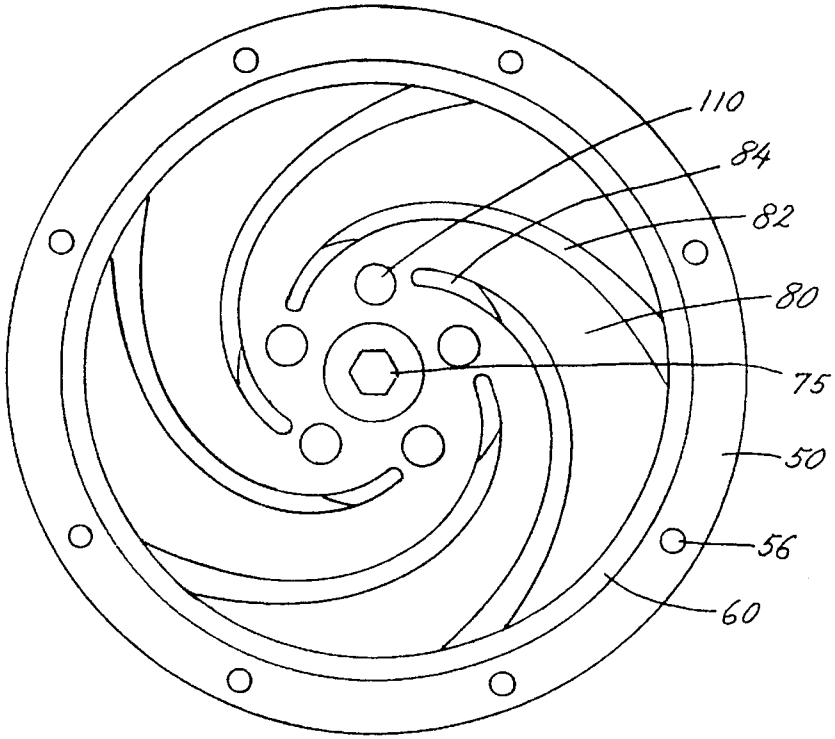
FIG. 3 is a front view of the impeller and pump housing of FIGS. 1–2 and 4–7 after the pump housing has been removed from the vessel.

FIG. 3 shows a frontal view of impeller 80 and pump housing 50 when pump 10 is opened for inspection or maintenance. As shown in the figures, impeller 80 is mounted on shaft 70 by means of bolt 75. FIG. 3 additionally shows the curved shape of impeller vanes 82 and the elongated portions 84 of the vanes which are located towards the center of impeller 80. Impeller 80 also includes flow holes 110 which are sometimes referred to in the art as balance holes. Flow holes 110 extend through impeller 80 in an axial direction to facilitate the escape of gases such as air that might collect in the vicinity of the impeller eye. As is additionally shown in FIGS. 1 and 2, bearing frame 60 and pump housing 50 are located behind impeller 80. FIG. 3 additionally shows holes 56 for receiving bolts 55 (shown in FIG. 1).

To reassemble pump 10 after it has been taken apart for inspection or maintenance, pump housing 50 including bearing frame 60, shaft 70 and impeller 80 are placed in proper alignment and brought together with sideplate 40 and volute collector 90. Bolts 55 are then utilized to hold pump housing 50, bearing frame 60 and impeller 80 in proper relation to volute collector 90 and sideplate 40.

In operation, impeller 80 rotates causing the fiber suspension or whatever is present within vanes 82 to be forced towards volute collector 90 and space 95 by means of centrifugal force. As the fiber suspension is forced into space 95, it is permitted to escape through discharge nozzle 100 (or 100B in FIG. 2). At the other end of impeller 80, the fiber suspension moves into impeller vanes 82 by virtue of the suction head of the fiber suspension in vessel 20 and a low pressure region in front of the impeller vanes 82 created as fiber suspension is caused to escape through discharge nozzle 100 (100B in FIG. 2). The low pressure near the elongated portions 84 of impeller vanes 82 is created as the fiber suspension moves past impeller vanes 82 and into space 95 of volute collector 90. The result is a self-perpetuated flow through pump 10.

In order to control the direction of flow from which the fiber suspension enters impeller vanes 82, in the embodiment of FIGS. 1 and 2, sideplate 40 includes extended portion 42 as noted above. In operation, extended portion 42 of sideplate 40 prevents fiber suspension from flowing into impeller vanes 82 from the area radially outside elongated portions 84 of impeller vanes 82. Instead, fiber suspension flows in substantially axial directions from in front of the circular space defined by the inner circumference of sideplate 40.

In operation, the preferred embodiment has been able to pump fiber suspensions of at least a consistency of 17%. Consequently, pump 10 is able to satisfy the requirements of high consistency applications while maintaining a higher efficiency and lower maintenance. Since pump 10 avoids the friction losses and flow resistances that many other pumps have, there is no need for additional machinery to agitate the suspension upstream of the impeller.

Figure 4:
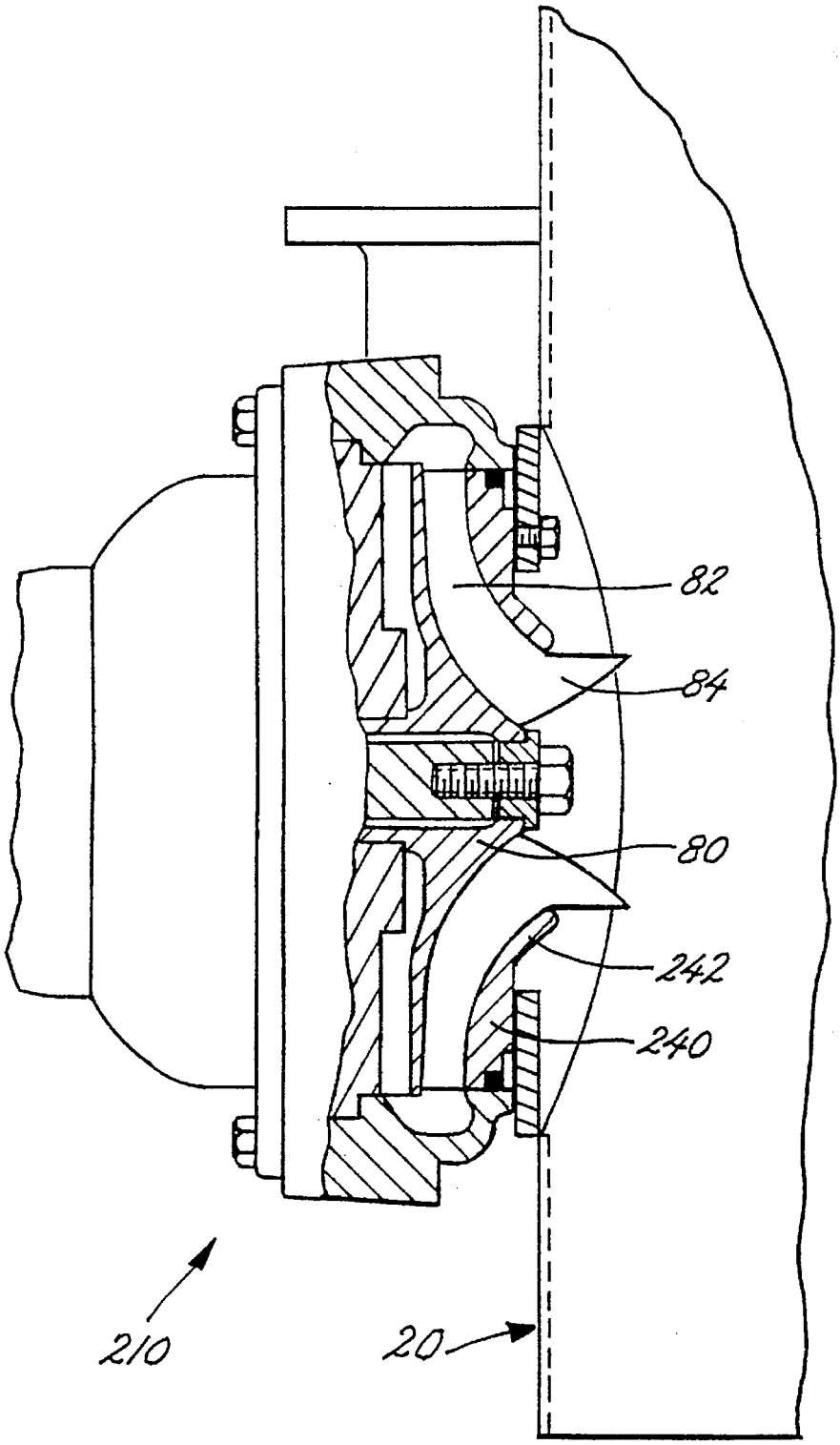
FIG. 4 is a partial side view of an alternative embodiment of the invention, shown in cross-section.
Figure 5:
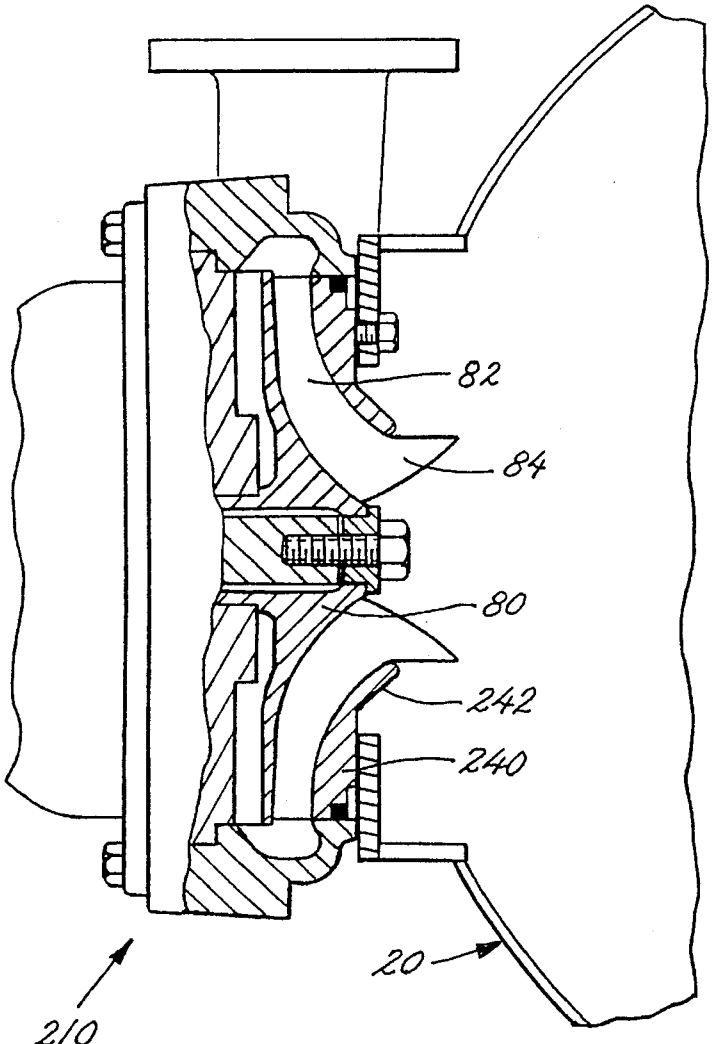
FIG. 5 is a partial top view of the same embodiment of the invention as shown in FIG. 4, except the pump is shown mounted to the vessel so that the discharge nozzle is horizontal rather than vertical.

FIGS. 4 and 5 show an alternative embodiment of the invention where the sideplate does not extend the entire length of elongated portions 84 of impeller vanes 82. As shown, sideplate 240 does not extend the entire length of the outside surface of elongated portion 84 of impeller vanes 82. As shown, in this alternative embodiment, elongated portion 242 of sideplate 240 terminates along the outer surface of impeller 80. Although elongated portion 242 of sideplate 240 is shown terminating at the point where the outer contour impeller vanes 82 becomes parallel with the axis of rotation, it is to be understood that the sideplate could terminate at any location along the outer contour of impeller vanes 82. In addition, elongated portion 242 of sideplate 240 could be formed separately from sideplate 240 and integrally with impeller 80 as a forward shroud. The leading edge of such a shroud could have an irregular shape, such as a scalloped shape.

In operation, this alternative embodiment works in a similar manner to the embodiment of FIGS. 1 and 2 and includes primarily the same advantages. However, as a result of sideplate 240 not extending along the entire length of the outer contour of impeller vanes 82, the flow of fiber suspension into impeller 80 of the alternative embodiment is different. Specifically, the fiber suspension enters impeller vanes 82 from all directions rather than simply in an axial direction from in front of impeller vanes 82.

Figure 7:
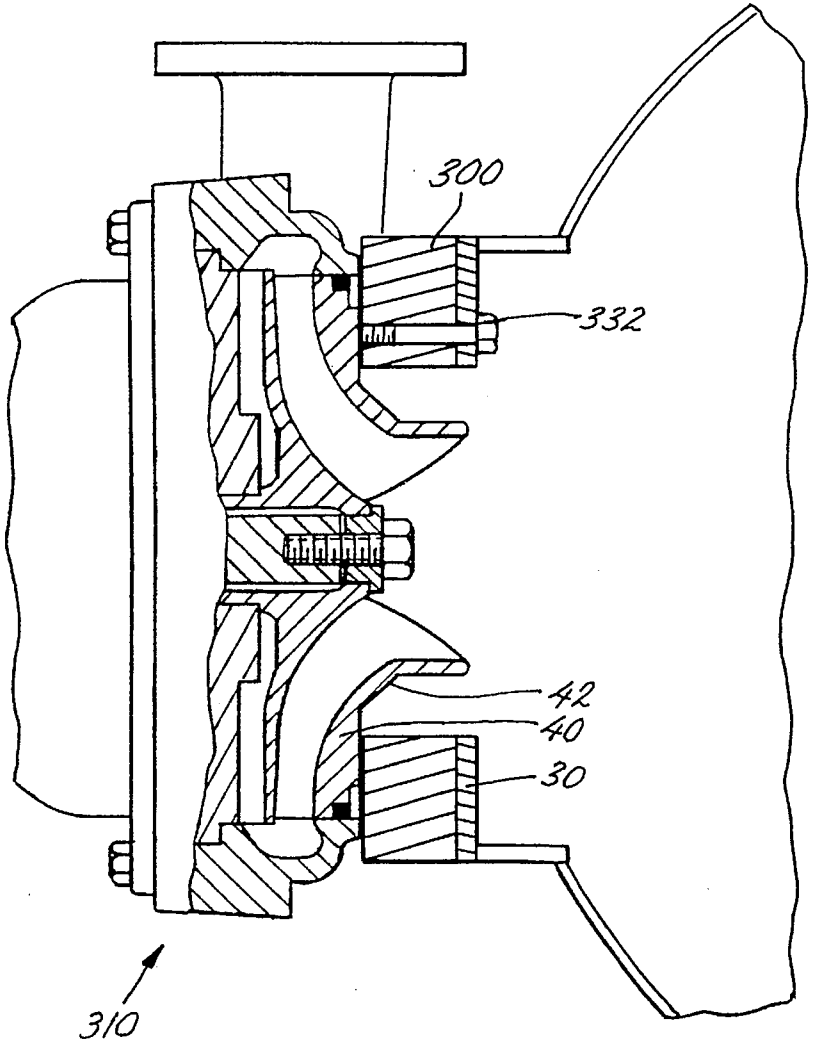
Figure 6:
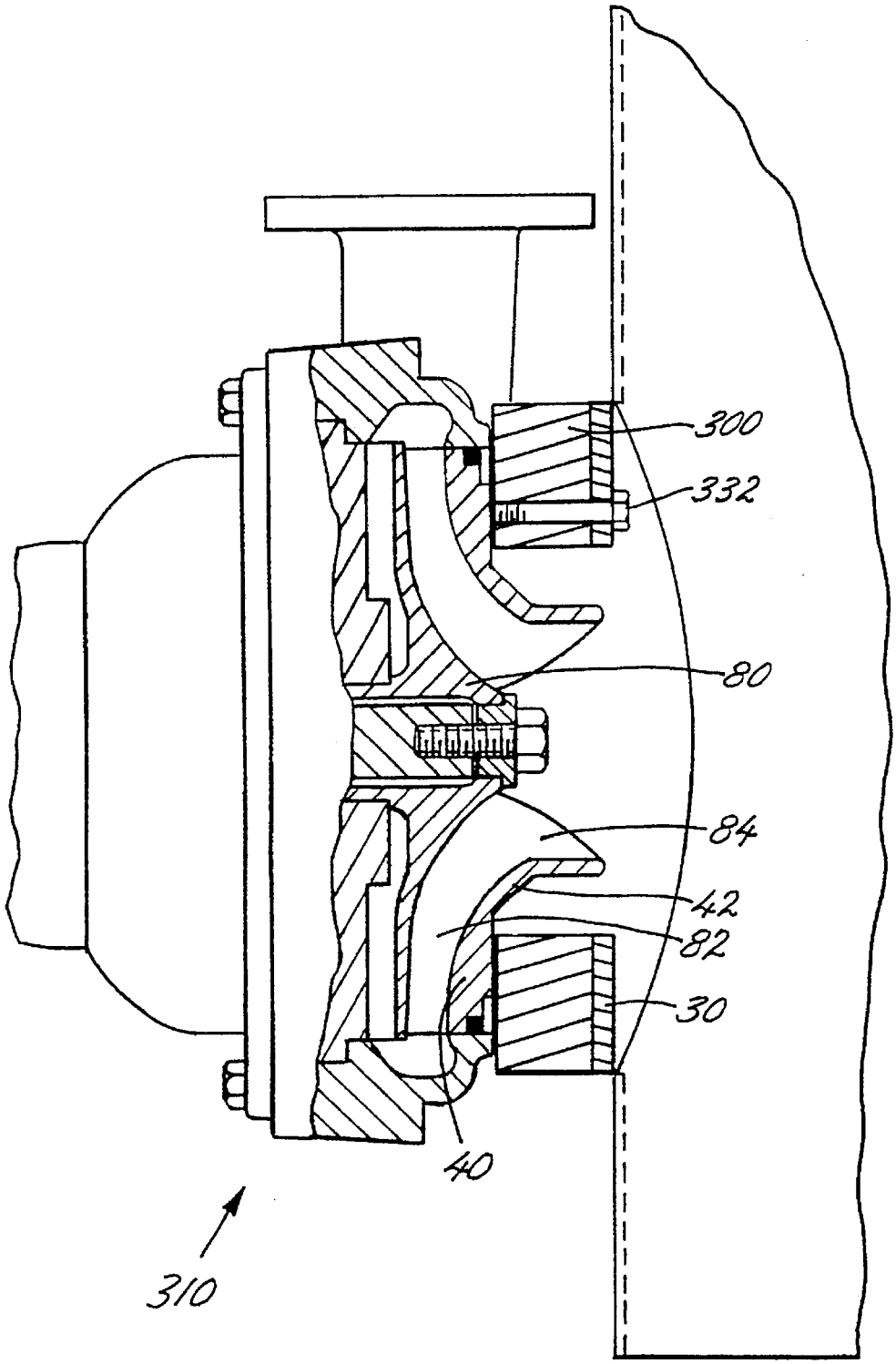
FIG. 6 is a partial side view of yet another alternative embodiment of the invention, shown in cross-section; and, FIG. 7 is a partial top view of the same embodiment of the invention as shown in FIG. 6, except the pump is shown mounted to the vessel so that the discharge nozzle is horizontal rather than vertical.

FIGS. 6 and 7 show another alternative embodiment where pump 10 is setback from the vessel by the inclusion of spacer ring 300. Spacer ring 300 is disposed intermediate flange 30 and sideplate 40. Spacer ring 300 is held in place by bolts 332 which extend through openings in the ring and connect with sideplate 40. As in the embodiment of FIGS. 1 and 2, sideplate 40 includes elongated portion 42 which extends along the outer contour of impeller vanes 82. It is noted, however, that sideplate 40 could be modified in a similar manner to the embodiment of the invention shown in FIGS. 4 and 5 if desirable.

In operation, pump 310 operates similarly to the previously described embodiments. As a result of sideplate 40 extending the entire length of the outer contour of impeller vanes 82, fiber suspension flows into impeller 80 in an axial direction from in front of impeller 80. At the same time, sideplate 40 offers additional structural support for extended portions 84 of impeller vanes 82. This alternative embodiment is preferable in any application where it is not desirable for the impeller of the pump to extend into the interior of the vessel.

While the invention is described in relation to three embodiments, it is to be understood that there are numerous other possible structural configurations. For example, the sideplate and the volute collector of the invention could be formed as part of the standpipe vessel and could be disposed within its walls. In such an embodiment, the discharge nozzle would extend from the standpipe vessel rather than being disposed outside the vessel as shown in the above-described embodiments. In other embodiments, the elongated portion of the impeller vanes could be shortened or extended to match the particular flow characteristics that might be required. In still other embodiments, the flange of the vessel could be constructed to act as the sideplate of the pump.

What is claimed is:

1. A centrifugal pump for pumping high consistency fiber suspensions from a cylindrical vessel including a side wall defining a cylindrical contour, the side wall further including an opening therein, said pump comprising:

a sideplate disposed adjacent to the opening in said side wall;

a pump housing assembly adapted to be in a fixed relation to said sideplate and including a shaft and a bearing frame rotatably supporting said shaft;

an impeller mounted for rotation with said shaft, said impeller having vanes including elongated portions which extend axially, said vanes and elongated portions having radially outermost surfaces which form an outside contour including a substantially axial portion; and at least a portion of said sideplate extending at least partially and in close proximity along the outside contour of said vanes for at least partially determining the directions from which the fiber suspensions enter said impeller;

said impeller being mounted to said vessel so that a portion of said impeller extends beyond the cylindrical contour defined by said side wall of said cylindrical vessel in the area of said opening in said wall; said impeller thereby directly contacting said high consistency fiber suspensions within said cylindrical vessel.

2. The centrifugal pump of claim 1, wherein the portion of said sideplate extending at least partially and in close proximity along the outside contour of said vanes is formed integrally with the remainder of said sideplate.

3. The centrifugal pump of claim 1, wherein the portion of said sideplate extending at least partially and in close proximity along the outside contour of said vanes also extends substantially circumferentially around said contour.

4. A centrifugal pumping apparatus including a pump for pumping high consistency fiber suspensions from a vessel maintaining a quantity of fiber suspensions, said centrifugal pumping apparatus comprising:

a vessel including a side wall defining a contour and further including an opening therein;

a sideplate disposed adjacent to said opening in said side wall;

a pump housing assembly adapted to be in a fixed relation to said sideplate and including a shaft and a bearing frame rotatably supporting said shaft; and an impeller mounted for rotation with said shaft, said impeller having vanes including elongated portions which extend axially, said vanes and elongated portions having radially outermost surfaces which form an outside contour including a substantially axial portion;

a portion of said sideplate extending at least partially and in close proximity along the outside contour of said vanes, at least said elongated portions of said impeller extending beyond the contour defined by the wall of the vessel and into the interior of the vessel; said side plate at least partially determining the directions from which the fiber suspensions enter said impeller.

5. The centrifugal pumping apparatus of claim 4, wherein the vessel includes a cylindrical sidewall defining a cylindrical contour.

6. The centrifugal pumping apparatus of claim 4, wherein the portion of said sideplate extending at least partially and in close proximity along the outside contour of said vanes is formed integrally with remainder of the said sideplate.

7. The centrifugal pumping apparatus of claim 4, wherein the portion of said sideplate extending at least partially and in close proximity along the outside contour of said vanes also extends substantially circumferentially around said contour.

8. A centrifugal pump for pumping high consistency fiber suspensions from a vessel including a side wall defining a cylindrical contour; the vessel including an opening for fluid communication with the pump; the pump comprising:

a pump housing assembly adapted to be mounted adjacent said vessel opening, and including a shaft and a bearing frame rotatably supporting said shaft;

an impeller mounted for rotation with said shaft, said impeller having vanes including elongated portions which extend axially, said vanes and elongated portions having radially outermost surfaces which form an outside contour including a substantially axial portion, at least said elongated portions extending into the interior of said vessel beyond the cylindrical contour in the area of said opening; and a means for determining the directions from which the fiber suspension enters said impeller, said means extending at least partially along and in close proximity with said outside contour of said vanes.

9. The centrifugal pump according to claim 8, further including a sideplate disposed adjacent to said opening in said vessel, said pump housing assembly being adapted to be in a fixed relation to said sideplate.

10. The centrifugal pump according to claim 9, wherein said means for determining the directions comprises an integral extension of said sideplate extending at least partially along and in close proximity with said outside contour of said vanes.

11. The centrifugal pump according to claim 8, wherein said means for determining the directions comprises a shroud extending at least partially along and in close proximity to the substantially axial portion of said outside contour of said vanes.

12. The centrifugal pump of claim 11, wherein said shroud extends substantially circumferentially around said outside contour.

13. A centrifugal pump for pumping high consistency fiber suspensions from a vessel maintaining a quantity of fiber suspensions; the vessel including an opening for fluid communication with the pump; the pump comprising:

a pump housing assembly adapted to be mounted adjacent said vessel opening, and including a shaft and a bearing frame rotatably supporting said shaft;

an impeller mounted for rotation with said shaft, said impeller having vanes including elongated portions which extend axially, said vanes and elongated portions having radially outermost surfaces which form an outside contour including a substantially axial portion, at least said elongated portions extending in the interior of said vessel and contacting the quantity of fiber suspensions to be pumped; and a means for determining the directions from which the fiber suspension enters said impeller, said means extending at least partially along and in close proximity with said outside contour of said vanes.

14. The centrifugal pump according to claim 13, including a sideplate disposed in fixed relation to said opening in said vessel, said pump housing assembly being adapted to be in a fixed relation to said sideplate.

15. The centrifugal pump according to claim 14, wherein said means for determining the directions comprising an integral extension of said sideplate extending at least partially along and in close proximity with said outside contour of said vanes.

16. The centrifugal pump according to claim 13, wherein said means for determining the directions comprises a shroud extending at least partially along and in close proximity with the substantially axial portion of said outside contour of said vanes.

17. The centrifugal pump of claim 16, wherein said shroud extends substantially circumferentially around said outside contour.

18. A method for making paper products including conveying fiber suspensions from a vessel including a cylindrical side wall defining a cylindrical contour and containing a quantity of fiber suspensions to a downstream point by a pump, the method comprising the steps of:

positioning a sideplate with respect to said vessel adjacent an opening in said vessel;

positioning a pump housing assembly in fixed relation to said sideplate, said pump housing including a shaft and a bearing frame rotatably supporting said shaft;

mounting an impeller having vanes including elongated portions of said shaft, such that the elongated portions of said impeller extend beyond the cylindrical contour in the area of the opening; and directing the flow of the quantity of fiber suspensions in an axial direction from immediately in front of the impeller vanes into the pump and preventing the quantity of fiber suspensions from contacting an outer circumferential surface of the impeller vanes.

* * * * *